US006932674B2

(12) United States Patent
Lahnor et al.

(10) Patent No.: US 6,932,674 B2
(45) Date of Patent: Aug. 23, 2005

(54) METHOD OF DETERMINING THE ENDPOINT OF A PLANARIZATION PROCESS

(75) Inventors: Peter Lahnor, Dresden (DE); Olaf Kuehn, Dresden (DE); Andreas Roemer, Dresden (DE); Alexander Simpson, Warrenville, IL (US)

(73) Assignee: Infineon Technologies Aktientgesellschaft, Munich (DE)

( * ) Notice: Subject to any disclaimer, the term of this patent is extended or adjusted under 35 U.S.C. 154(b) by 0 days.

(21) Appl. No.: 10/248,950

(22) Filed: Mar. 5, 2003

(65) Prior Publication Data

US 2004/0176015 A1 Sep. 9, 2004

(51) Int. Cl.[7] ..... B24B 49/00
(52) U.S. Cl. ..... 451/8; 451/5; 451/6; 451/296
(58) Field of Search ..... 451/8, 5, 6, 296, 451/41, 9, 10, 297; 438/692, 693

(56) References Cited

U.S. PATENT DOCUMENTS

| | | | | | |
|---|---|---|---|---|---|
| 5,851,135 | A | * | 12/1998 | Sandhu et al. | 451/5 |
| 6,179,688 | B1 | * | 1/2001 | Beckage et al. | 451/6 |
| 6,190,234 | B1 | * | 2/2001 | Swedek et al. | 451/6 |
| 6,213,845 | B1 | * | 4/2001 | Elledge | 451/6 |
| 6,375,540 | B1 | * | 4/2002 | Mikhaylich et al. | 451/6 |
| 6,431,953 | B1 | * | 8/2002 | Carter et al. | 451/5 |
| 6,447,369 | B1 | * | 9/2002 | Moore | 451/6 |
| 6,461,964 | B2 | * | 10/2002 | Hofmann et al. | 438/692 |
| 6,464,824 | B1 | * | 10/2002 | Hofmann et al. | 156/345.16 |
| 6,612,901 | B1 | * | 9/2003 | Agarwal | 451/6 |

* cited by examiner

*Primary Examiner*—Dung Van Nguyen
(74) *Attorney, Agent, or Firm*—Slater & Matsil, L.L.P.

(57) ABSTRACT

A method of determining the endpoint of a planarizing process is disclosed. An endpoint detection signal is selectively sampled from at least one predetermined location within a planarizing region defined on a planarizing web. Planarization is stopped when the endpoint criterion based on the endpoint detection signal is detected.

34 Claims, 5 Drawing Sheets

METHOD OF DETERMINING THE ENDPOINT OF A PLANARIZATION PROCESS

BACKGROUND OF INVENTION

Mechanical or chemical-mechanical planarizing processes (CMP) are used to form a substantially flat surface on microelectronic substrates such as semiconductor wafers used in the fabrication of semiconductor devices. FIG. 1 shows a planarizing apparatus 100 comprising a planarizing web medium 102 stretched over a platen 104 and a substrate holder 106 that holds the substrate 108. The planarizing medium comprises, for example, a fixed abrasive planarizing web. A fixed abrasive web comprises abrasive particles embedded within a suspension medium. In one embodiment, the planarizing apparatus has a plurality of rollers to supply, guide and collect the web-format planarizing medium. The rollers include a supply roller 110 to supply the fresh or un-used portion of the web and a take-up roller 112 to collect the worn or used portion of the web. The web is advanced across the platen such that a fresh portion of the web is introduced into the planarizing region 114 and a worn portion of the web is collected at the take-up roller 112.

During planarization, the substrate holder presses the substrate against the planarizing medium, translates and/or rotates it to planarize the substrate. It is desirable to accurately determine the endpoint of the planarization process. This is to prevent over-polish of substrates that may lead to excessive thinning, or under-polish that leaves residual material on the substrate surface, which results in defective substrates and leads to the formation of defective microelectronic components on the substrate or loss in throughput.

Conventional end-point detection (EPD) methods include optical EPD which detects the reflectivity changes of the substrate surface resulting from the removal of material from the surface of the substrate, or motor current EPD which is an indirect measurement of the frictional force changes between the substrate and the planarizing medium. Other EPD methods include thermal or acoustic EPD which also detect variations in friction during the progression of the planarization process.

However, these conventional methods do not differentiate between fresh or used portions on the planarizing web surface, which exhibit different physical properties. It is desirable to provide a more reliable method of detecting the appropriate endpoint of mechanical and/or chemical mechanical planarization processes.

SUMMARY OF INVENTION

The present invention relates to the planarization of microelectronic substrates. More particularly, the invention relates to a method of determining the endpoint of a planarization process. A planarizing web having a planarizing region defined thereon is provided, the planarizing web being moveable to move one portion of the web out of the planarizing region and another portion into the planarizing region. An endpoint detection signal is selectively sampled from at least one predetermined location within the planarizing region. The endpoint criterion is based on the endpoint detection signal, and is used to determine the appropriate endpoint of the planarization process.

DETAILED DESCRIPTION

Figure 1:
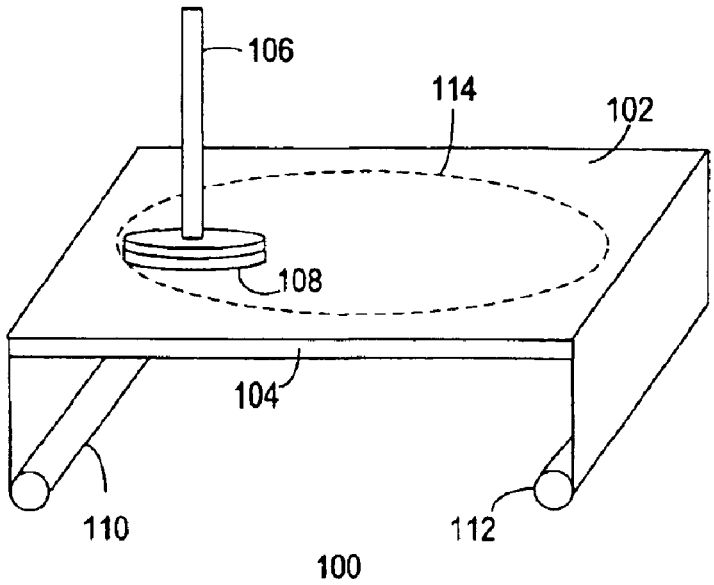
FIG 1 prior art
FIG. 1 shows a conventional planarizing apparatus.
Figure 2:
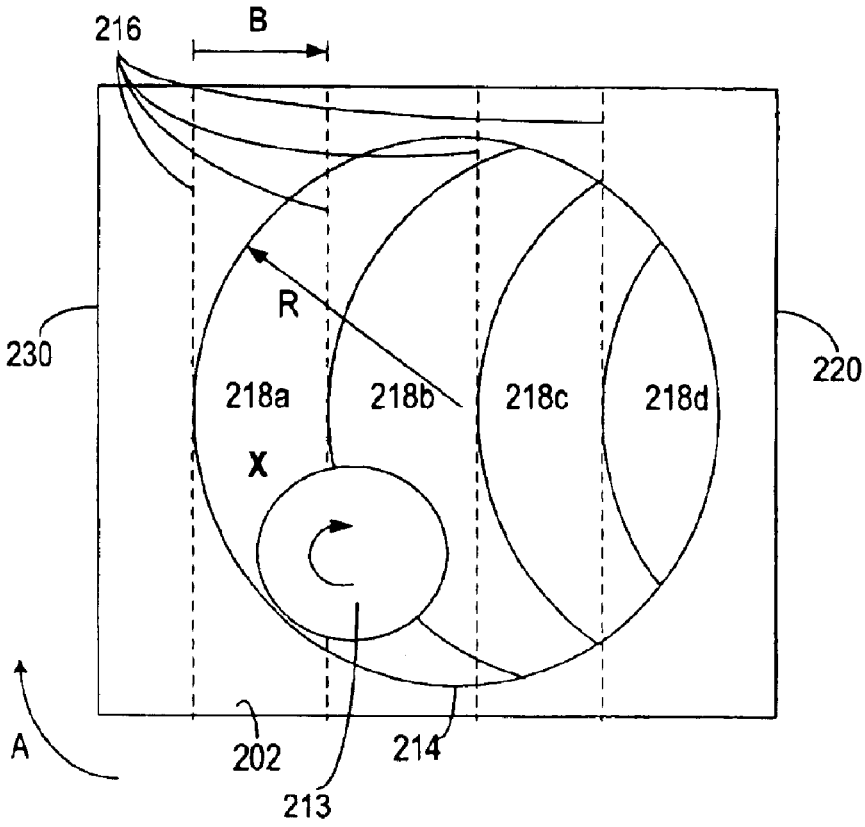
FIG. 2 shows a planar view of a planarizing apparatus in accordance with one embodiment of the invention.

FIG. 2 shows a planar view of a planarizing apparatus in accordance with one embodiment of the invention. The planarizing web 202 has a planarizing region 214 defined thereon. During the planarization process, the substrate 213 is held against the planarizing medium 202 and continuously translated and/or rotated relative to the planarizing web in, for example, direction A, within the planarizing region. Other directions are also useful. The planarizing region, in one embodiment, is circular. The planarizing region may comprise other irregular or regular shapes, such as a rectangular shape or a square shape.

Typically, the substrate is rotated about the planarizing region. The radius R of the planarizing region is, for example greater than the diameter of the substrate.

Providing a radius R which is equal to or less than the diameter of the substrate is also useful. In addition, the substrate itself can also be rotated, for example, in a clockwise direction while it is being rotated in the planarizing region. Rotating the substrate in a counter clockwise direction is also useful.

The planarizing medium is preferably moveable to move one portion of the planarizing web into the planarizing region and another portion of the web out of the planarizing region. The web material may be guided, positioned and held in place over a supporting platen using a plurality of rollers (not shown). In one embodiment, supply and take-up rollers may be used to drive the web in, for example, direction B, incrementally in steps indicated by the dashed lines 216, to replace worn portions of the web. Moving the web material in other directions is also useful.

In one embodiment, the planarizing web comprises a fixed abrasive medium, having abrasive particles embedded in a suspension medium. The abrasive particles serve to planarize the surface of a substrate, and comprise, for example, zirconia, silica, ceria, alumina, sand, diamond or a combination thereof. The suspension medium comprises, for example, a polymer material such as resin. Other types of abrasive particles and/or suspension media are also useful.

The endpoint is determined using an endpoint detection (EPD) signal. An EPD signal can be generated using various EPD techniques. For example, the EPD can be generated using motor current, frictional, optical, electrical, electrochemical, acoustic, vibration, thermal techniques or a combination thereof. Other EPD techniques are also useful. In one embodiment, the motor current driving the substrate holder is measured to detect changes in friction between the substrate and the planarizing medium. The friction between the substrate and the planarizing medium changes during the planarization process due to, for example, breakthrough of one layer to another or more surface area contacting the planarizing medium as the substrate surface becomes more planar.

Figure 3:
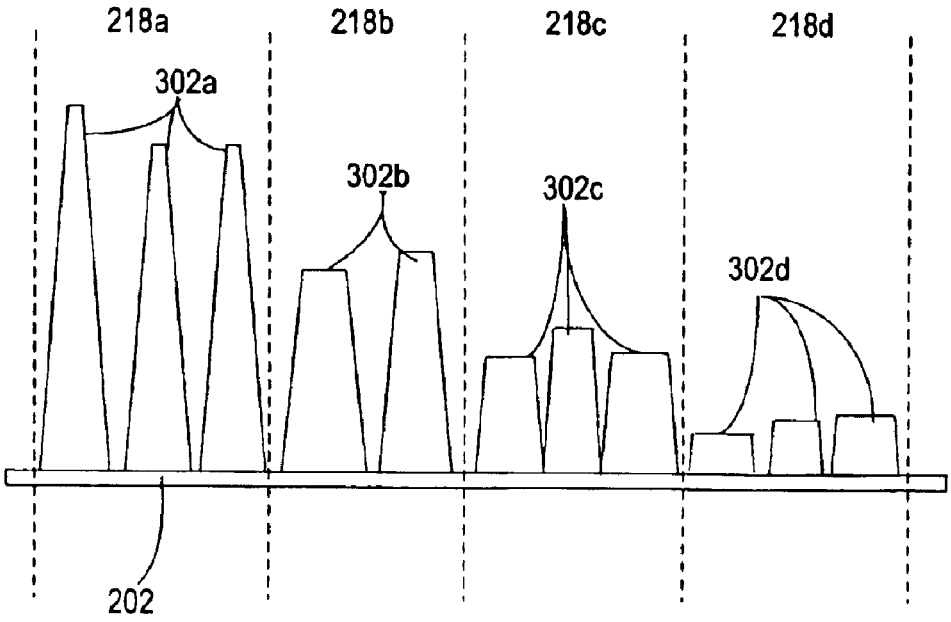
FIG. 3 shows a cross-sectional view of a planarizing web in accordance with one embodiment of the invention.

However, the EPD signal sampled from different portions on the web is different since different portions 218 of the web are worn down at different levels. For example, the portion 218*d*closer to the side of the take-up roller 220 is more worn down than the portion 218*a*closer to the side of the supply roller 230. The non-uniform topography of the different portions of the web surface is illustrated in the cross-sectional view of the planarizing web shown in FIG. 3. The average height of the web posts 302*a–d*on the surface of the web medium generally decreases with increasing wear. The area of the top surfaces of the web posts also changes with the level of wear, leading to variations in physical properties. The EPD signal, which represents for example, the frictional force between the substrate and the web, will differ when sampled in region 218*a*from that sampled in the more worn down region 218*d*during the same planarization cycle (or rotation cycle of the substrate).

Figure 5:
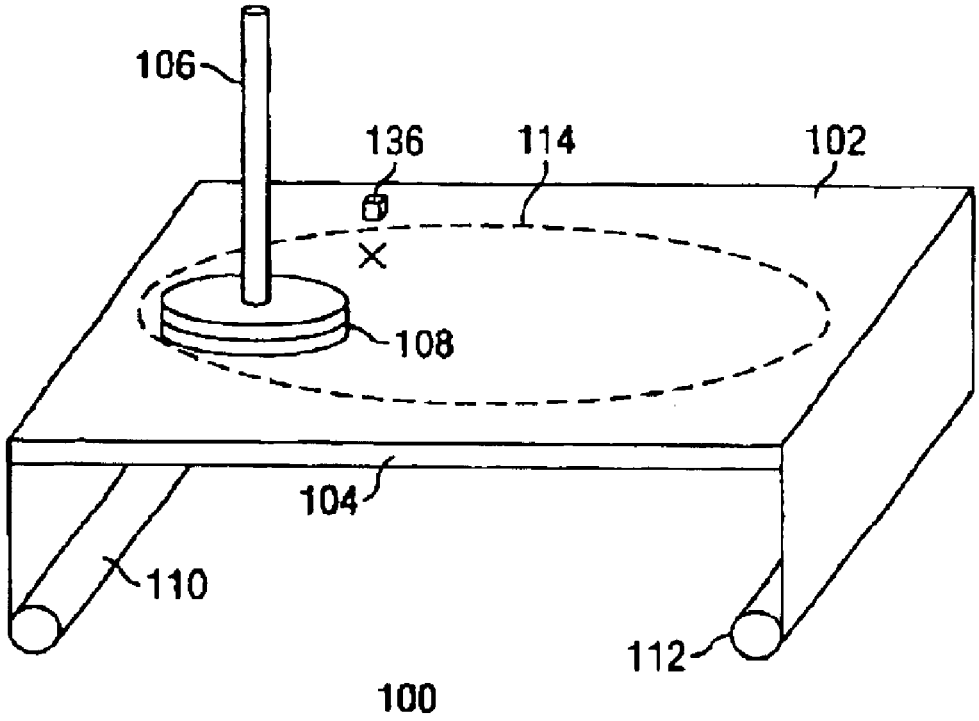
FIG. 5 shows a planarizing apparatus that includes a position sensor.

In accordance with one embodiment of the invention, the EPD signal is selectively sampled from at least one predetermined location within the planarizing region. For example, the EPD signal is selectively sampled from the location 'X' in region 218*a* as shown in FIG. 2, which comprises mostly of fresh web material. Other locations are also useful. In one embodiment, this is achieved by using a position sensor for selectively activating the sampling of the EPD signal. As shown in FIG. 5, the position sensor 130 may be attached to the supporting platen 104 for activating the sampling when the substrate 108 passes the predetermined location. The position sensor comprises, for example, an optical, mechanical or magnetic trigger sensor or switch that activates the sampling then the substrate passes the predetermined location on the planarizing web. Other types of sensors are also useful. In another embodiment, the EPD signal is sampled at predetermined time intervals, such that the EPD signal is selectively sampled at predetermined locations the planarizing web. This is achieved by, for example, a timer, assuming a constant rotation speed.

In one embodiment, the planarization of a substrate is stopped if an endpoint criterion based on the endpoint detection signal is detected. For example, if the EPD signal reaches a predetermined range, the planarization is stopped. Other types of endpoint criteria, such as predefined arithmetic functions, may also be used. In one embodiment, a control unit comprising the necessary control logic is provided to stop the planarization when the endpoint criterion is detected. By measuring the EPD signal from specific portions on the web, the determination of the appropriate endpoint based on the EPD signal is more reliable and accurate.

Figure 4:
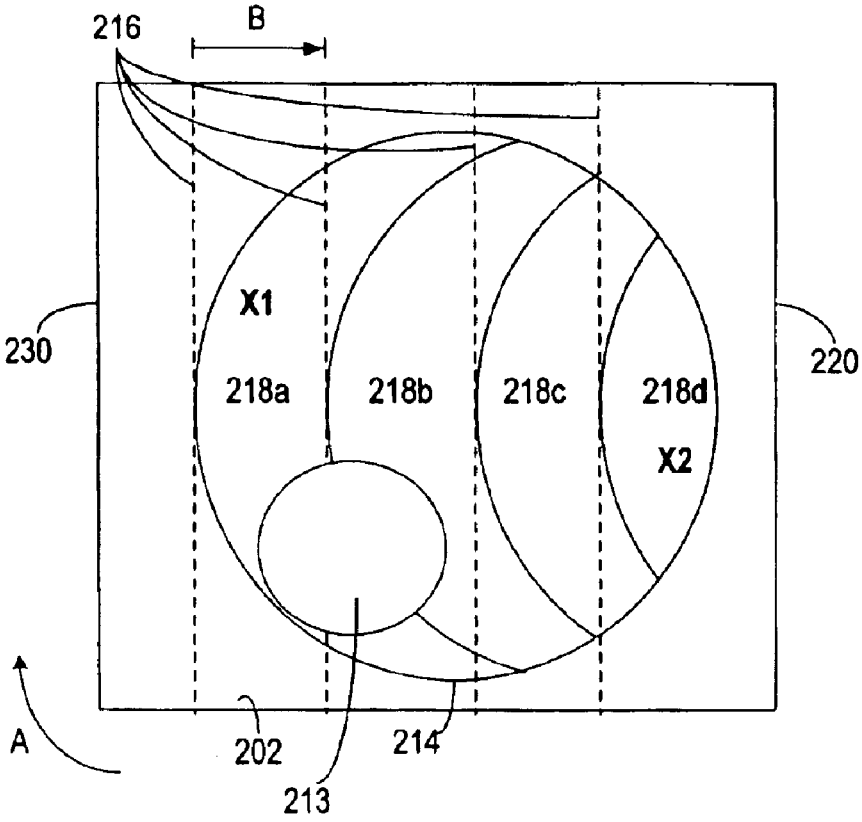
FIG. 4 shows a planar view of a planarizing apparatus in accordance with another embodiment of the invention.

In another embodiment of the invention shown in FIG. 4, the EPD signal is selectively sampled from a plurality of predetermined locations within the planarizing region (e.g. X1 and X2). In one embodiment, a combined signal is computed from the EPD signal samples from different predefined locations on the web surface. For example, if A is the EPD signal sample measured from location X1 and B is the signal sample from location X2, then the combined EPD signal C may be computed from the difference between the two signal samples (C=A−B). Alternatively, the combined signal may be computed from the ratio of the EPD signal samples (C=A/B). In yet another embodiment, the combined signal is computed from the ratio of the difference to the sum of the signal samples (C=(A−B)/(A+B)). The combined signal may then be used to detect the endpoint criterion of the planarization process. For example, if the combined signal reaches a predetermined range, the planarization is stopped. Other types of endpoint criteria, such as predefined arithmetic functions may also be useful.

While the invention has been particularly shown and described with reference to various embodiments, it will be recognized by those skilled in the art that modifications and changes may be made to the present invention without departing from the spirit and scope thereof. The scope of the invention should therefore be determined not with reference to the above description but with reference to the appended claims along with their full scope of equivalents.

What is claimed is:

1. A method of determining an endpoint of a planarizing processing comprising:

providing a planarizing web having a planarizing region defined thereon, the planarizing web being moveable to move one portion of the planarizing web out of the planarizing region and another portion of the planarizing web into the planarizing region;

selectively sampling an endpoint detection signal from at least one predetermined location within the planarizing region, the endpoint detection signal being based upon a detection of friction between a substrate and the planarizing web, wherein the step of selectively sampling the endpoint detection signal comprises selectively activating the sampling of the endpoint detection signal using a position sensor; and stopping planarizing of the substrate if an endpoint criterion based on the endpoint detection signal is detected.

2. The method of claim 1 wherein the planarizing web comprises a fixed abrasive medium.

3. The method of claim 1 wherein the position sensor selectively activates the sampling when the substrate passes the predetermined location.

4. The method of claim 3 wherein the position sensor comprises an optical, mechanical or magnetic trigger sensor.

5. The method of claim 1 wherein the endpoint criterion comprises the endpoint detection signal reaching a predetermined range.

6. A method of determining an endpoint of a planarizing process, the method comprising:

providing a planarizing web having a planarizing region refined thereon, the planarizing web being moveable to move one portion of the planarizing web out of the planarizing region and another portion of the planarizing web into the planarizing region;

selectively sampling an endpoint detection signal from at least one predetermined location within the planarizing region, the endpoint detection signal being based upon a detection of friction between a substrate and the planarizing web, wherein the step of selectively sampling the endpoint detection signal comprises selectively sampling the endpoint detection signal from a plurality of predetermined locations within the planarizing region; and stopping planarizing of the substrate if an endpoint criterion based on the endpoint detection signal is detected.

7. The method of claim 6 wherein the step of selectively sampling the endpoint detection signal comprises sampling the endpoint detection signal at predetermined time intervals.

8. The method of claim 6 wherein the step of selectively sampling the endpoint detection signal comprises selectively activating the sampling of the endpoint detection signal using a position sensor.

9. The method of claim 8 wherein the position sensor selectively activates the sampling when the substrate passes the predetermined location.

10. The method of claim 9 wherein the position sensor comprises an optical, mechanical or magnetic trigger sensor.

11. The method of claim 6 and further comprising computing a combined signal from the endpoint detection signal samples, wherein the combined signal comprises a ratio of the endpoint detection signal samples.

12. A method of determining an endpoint of a planarizing process comprising:

providing a planarizing web having a planarizing region defined thereon, the planarizing web being moveable to move one portion of the planarizing web out of a planarizing region and another portion of the planarizing web into the planarizing region;

selectively sampling endpoint detection signals from a plurality of predetermined locations within the planarizing region;

computing a combined signal from endpoint detection signal samples from the plurality of predetermined locations, wherein the combined signal comprises a ratio of the endpoint detection signal samples; and stopping planarizing of a substrate if an endpoint criterion based on the combined signal from endpoint detection signal is detected.

13. The method of claim 12 wherein the combined signal comprises a difference between the endpoint detection signal samples.

14. The method of claim 12 wherein the combined signal comprises a ratio of a difference to a sum of the endpoint detection signal samples.

15. The method of claim 12 wherein the endpoint criterion comprises the combined signal reaching a predetermined range.

16. The apparatus of claim 12 wherein sampling the endpoint detection signals comprises using motor current, frictional, optical, electrical, electrochemical, acoustic, vibration or thermal methods.

17. An apparatus for planarizing substrate comprising:

a planarizing web having a planarizing region defined thereon, the planarizing web being moveable to move one portion of the planarizing web out of the planarizing region and another portion of the planarizing web into the planarizing region;

a position sensor for selectively activating sampling of endpoint detection signal from at least one predetermined position within the planarizing region; and a control unit for stopping planarizing of a substrate if an endpoint criterion based on endpoint detection signal samples is detected, the endpoint detection signal samples being based upon changes in friction between the substrate and the planarizing web.

18. The apparatus of claim 17 and further comprising a supply roller connected to one end of the planarizing web and a take-up roller connected to a second end of the planarizing web.

19. The apparatus of claim 17 wherein the position sensor selectively activates the sampling when the substrate passes the predetermined location.

20. The apparatus of claim 19 wherein the position sensor comprises an optical, mechanical or magnetic trigger sensor.

21. The apparatus of claim 17 wherein the planarizing web comprises a fixed abrasive medium.

22. A method of determining an endpoint of a planarizing process comprising:

sampling an endpoint detection signal from a plurality of predetermined locations within a planarizing region;

computing a combined signal from endpoint detection signal samples from the plurality of predetermined locations, wherein the combined signal comprises a ratio of the endpoint detection signal samples; and stopping planarizing of a substrate if an endpoint criterion based on the endpoint detection signal is detected.

23. The method of claim 22 wherein the combined signal comprises a ratio of a difference to a sum of the endpoint detection signal samples.

24. The method of claim 22 further comprises generating the endpoint detection signal using motor current, frictional, optical, electrical, electrochemical, acoustic, vibration, thermal techniques or a combination thereof.

25. The method of claim 22 wherein the planarizing web comprises a fixed abrasive medium.

26. The method of claim 25 further comprises generating the endpoint detection signal using motor current, frictional, optical, electrical, electrochemical, acoustic, vibration or thermal methods.

27. A method of manufacturing a semiconductor device, the method comprising:

providing a semiconductor wafer with a layer to be polished;

contacting the layer to be polished with a planarizing region of a planarizing web;

moving the planarizing web in a linear direction such that one portion of the planarizing web is moved out of the planarizing region and another portion the planarizing web is moved into the planarizing region;

moving the semiconductor wafer within the planarizing region;

sampling an endpoint detection signal from at least one predetermined location within the planarizing region when the semiconductor wafer passes the at least one predetermined location, the endpoint detection signal being based upon a detection of friction between a substrate and the planarizing web, wherein sampling the endpoint detection signal comprises selectively activating the sampling of the endpoint detection signal using a position sensor that activates the sampling when the substrate passes the at least one predetermined location; and stopping planarizing of the semiconductor wafer if an endpoint criterion based on the endpoint detection signal is detected.

28. The method of claim 27 wherein the planarizing web comprises a fixed abrasive medium.

29. A method of manufacturing a semiconductor device, the method comprising:

providing a semiconductor wafer with a layer to be polished;

contacting the layer to be polished with a planarizing region of a planarizing web;

moving the planarizing web in a linear direction such that one portion of the planarizing web is moved out of the planarizing region and another portion of the planarizing web is moved into the planarizing region;

moving the semiconductor wafer within the planarizing region;

sampling an endpoint detection signal from at least one predetermined location within the planarizing region when the semiconductor wafer passes the at least one predetermined location, the endpoint detection signal being based upon a detection of friction between a substrate and the planarizing web, wherein sampling the endpoint detection signal comprises sampling the endpoint detection signal from a plurality of predetermined locations within the planarizing region; and stopping planarizing of the semiconductor wafer if an endpoint criterion based on the endpoint detection signal is detected.

30. The method of claim 29 wherein sampling the endpoint detection signal comprises sampling the endpoint detection signal at predetermined time intervals.

31. The method of claim 29 further comprises computing a combined signal from endpoint detection signal samples from the plurality of predetermined locations.

32. The method of claim 31 wherein the combined signal comprises a difference between the endpoint detection signal samples.

33. A method of manufacturing a semiconductor device, the method comprising:

providing a semiconductor wafer with a layer to be polished;

contacting the layer to be polished with a planarizing region of a planarizing web;

moving the planarizing web in a linear direction such that one portion of the planarizing web is moved out of the planarizing region and another portion of the planarizing web is moved into the planarizing region;

moving the semiconductor wafer within the planarizing region;

sampling an endpoint detection signal from at least one predetermined location within the planarizing region when the semiconductor wafer passes the at least one predetermined location, wherein sampling the endpoint detection signal comprises sampling the endpoint detection signal from a plurality of predetermined locations within the planarizing region;

computing a combined signal from endpoint detection signal samples from the plurality of predetermined locations, wherein the combined signal comprises a ratio of the endpoint detection signal samples; and stopping planarizing of the semiconductor wafer if an endpoint criterion based on the combined signal is detected.

34. The method of claim 33 wherein the combined signal comprises a ratio of a difference to a sum of the endpoint detection signal samples.

* * * * *

UNITED STATES PATENT AND TRADEMARK OFFICE

CERTIFICATE OF CORRECTION

PATENT NO. : 6,932,674 B2
DATED : August 23, 2005
INVENTOR(S) : Lahnor et al.

It is certified that error appears in the above-identified patent and that said Letters Patent is hereby corrected as shown below:

Column 3,
Line 1, delete “218dcloser” insert -- 218d closer --.
Line 2, delete “218acloser” insert -- 218a closer --.
Line 6, delete “302a-don” insert -- 302a-d on --.
Line 12, delete “218afrom” insert -- 218a from --.
Line 13, delete “218dcloser” insert -- 218d closer --.

Column 4,
Line 9, delete “processing” insert -- process --.
Line 39, delete “refined” insert -- defined --.

Column 5,
Line 34, delete “planarizing substrate” insert -- planarizing a substrate --.
Line 40, delete “of endpoint” insert -- of an endpoint --.

Column 6,
Line 23, delete “portion the” insert -- portion of the --.

Signed and Sealed this

Twenty-second Day of November, 2005

JON W. DUDAS
*Director of the United States Patent and Trademark Office*